US009909382B2

(12) United States Patent
Schmidt et al.

(10) Patent No.: US 9,909,382 B2
(45) Date of Patent: Mar. 6, 2018

(54) SUBSURFACE WIPING PLUG APPARATUS, METHOD, AND SYSTEM

(71) Applicant: Halliburton Energy Services, Inc., Houston, TX (US)

(72) Inventors: Daniel Lee Schmidt, Dallas, TX (US); Gary Joe Makowiecki, Spring, TX (US); Patrick Lyle Cherney, Newton, KS (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/031,569

(22) PCT Filed: Dec. 23, 2014

(86) PCT No.: PCT/US2014/072171
§ 371 (c)(1),
(2) Date: Apr. 22, 2016

(87) PCT Pub. No.: WO2016/105388
PCT Pub. Date: Jun. 30, 2016

(65) Prior Publication Data

US 2016/0340999 A1 Nov. 24, 2016

(51) Int. Cl.

| | |
|---|---|
| ***E21B 33/12*** | (2006.01) |
| ***E21B 33/126*** | (2006.01) |
| ***E21B 33/14*** | (2006.01) |
| ***E21B 34/06*** | (2006.01) |
| *E21B 34/00* | (2006.01) |

(52) U.S. Cl.
CPC ..... *E21B 33/12* (2013.01); *E21B 33/126* (2013.01); *E21B 33/14* (2013.01); *E21B 34/06* (2013.01); *E21B 2034/007* (2013.01)

(58) Field of Classification Search
CPC ..... E21B 33/12; E21B 33/13; E21B 33/14; E21B 33/16; E21B 34/06; E21B 2034/007
See application file for complete search history.

(56) References Cited

U.S. PATENT DOCUMENTS

| | | | | |
|---|---|---|---|---|
| 5,522,458 | A | 6/1996 | Watson et al. | |
| 2006/0237186 | A1 | 10/2006 | Mondelli et al. | |
| 2007/0158069 | A1 | 7/2007 | Vert et al. | |
| 2009/0250217 | A1 | 10/2009 | Webb et al. | |
| 2011/0146986 | A1* | 6/2011 | Giem | E21B 33/16 166/291 |
| 2013/0112410 | A1 | 5/2013 | Szarka et al. | |

OTHER PUBLICATIONS

"International Application Serial No. PCT/US2014/072171, International Search Report dated Sep. 1, 2015", 4 pgs.
"International Application Serial No. PCT/US2014/072171, Written Opinion dated Sep. 1, 2015", 4 pgs.

* cited by examiner

*Primary Examiner* — Brad Harcourt
(74) *Attorney, Agent, or Firm* — Chamberlain Hrdlicka

(57) ABSTRACT

In some embodiments, a subsurface wiping plug apparatus includes an internal bore that extends for less than a length of the apparatus. A ported case encloses internal components of the apparatus such that each port of the case is configured to couple the internal bore to an external side of the case. A plug capsule is coupled to an end of the ported case. The plug capsule contains an internal wiping plug that is releasable by internal pressure.

24 Claims, 9 Drawing Sheets

SUBSURFACE WIPING PLUG APPARATUS, METHOD, AND SYSTEM

PRIORITY APPLICATIONS

This application is a U.S. National Stage Filing under 35 U.S.C. § 371 from International Application No. PCT/US2014/072171, filed Dec. 23, 2014; which application is incorporated herein by reference in its entirety.

BACKGROUND

During a well drilling operation, cement casing is typically inserted into the borehole to provide structural support for the borehole in unstable geological formations in addition to sealing the borehole. The casing is typically cemented in place by circulating a cement slurry through the inside of the casing and out into the annulus through a casing shoe at the bottom of the casing string. To prevent the cement from flowing back into the inside of the casing, a float collar above the casing shoe may be used to act as a check valve and prevent the fluid from flowing up through the shoe from the annulus.

After an initial casing is inserted and cemented into the borehole, another smaller casing may be inserted with a liner hanger on a running tool and cemented into the borehole in a similar fashion. This may continue downward into the borehole in a telescoping fashion as the inserted casings become progressively smaller diameter.

The running tool, with a plug system coupled to the bottom, holds the liner casing as the running tool descends through the borehole. The downhole environment may include multiple downhole tools, having central bores, that are part of the casing. Similarly, conventional wiping plugs of the plug system have a central bore through which fluid flows. Additionally, multiple conventional plugs are used from the surface to the toe of the well due to the diameter changes between the drill pipe and liner hanger setting tool, and the casing in the liner. The use of these conventional plugs limits the quantity of sleeve tools possible within the liner casing due to the larger diameter of the plug used to wipe the cement.

DETAILED DESCRIPTION

To address some of the challenges described above, as well as others, the subsurface wiping plug apparatus provides a cementing system for liner hangers. Current plug systems are substantially limited as to the number of sleeves that can be used due to a larger diameter of those plugs as a result of an inner bore of the plugs. Additionally, a single plug may not result in a reliable wiping operation from the surface to the toe of the well due to the diameter changes between the drill pipe used to run the liner hanger assembly, a liner hanger setting tool, and a casing used in the liner. The subsequently disclosed subsurface wiping plug apparatus does not include an internal bore and, thus, may be made smaller to enable its use in smaller boreholes.

Figure 1:
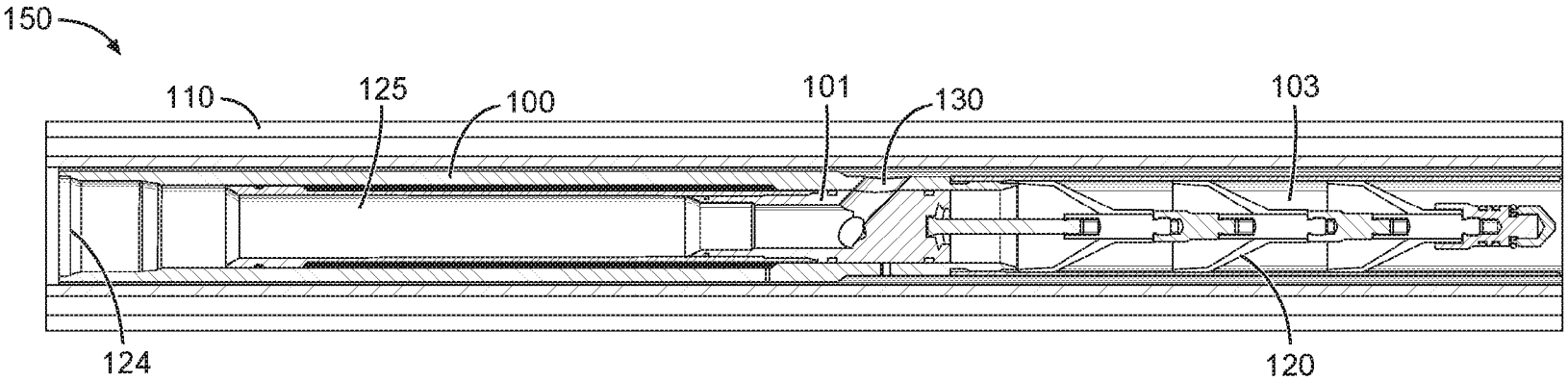
FIG. 1 is a cross-sectional diagram showing an example subsurface wiping plug apparatus according to aspects of the present disclosure.

FIG. 1 is a cross-sectional diagram showing an example subsurface wiping plug apparatus 150 according to aspects of the present disclosure. The apparatus 150 includes a ported case 100 in which are located a slidable sleeve 101 and a plug capsule 103. The plug capsule 103 includes a plug 120 inside. FIG. 1 also shows the apparatus 150 located within a casing 110 of a borehole.

The ported case 100 includes threaded opening 124 for an internal bore 125 through a portion of the ported case 100 up to the plug capsule 103. The threaded opening attaches to a running tool. The internal bore 125 of the case 100 is ported to the annulus between the well casing 110 and the case 100 of the apparatus 150 through one or more front ports 130 in the side of the case 100. The cross-sectional view of FIG. 1 shows only one such port 130. However, a plurality of front ports 130 may be distributed circumferentially around the case 100. The front ports 130 are connected to the internal bore 125 such that any fluid (e.g., cement slurry, displacement fluid) that enters the opening 124 at the end of the apparatus 150 can be forced under pressure through the bore 125 of the apparatus 150 and out the one or more front ports 130. The front ports 130 exit to an annulus region between the apparatus and the borehole casing in order to bypass around the plug capsule 103 instead of going through the plug capsule. This concept is illustrated in greater detail in FIG. 2. The plug has a solid core instead of a hollow core.

Figure 2:
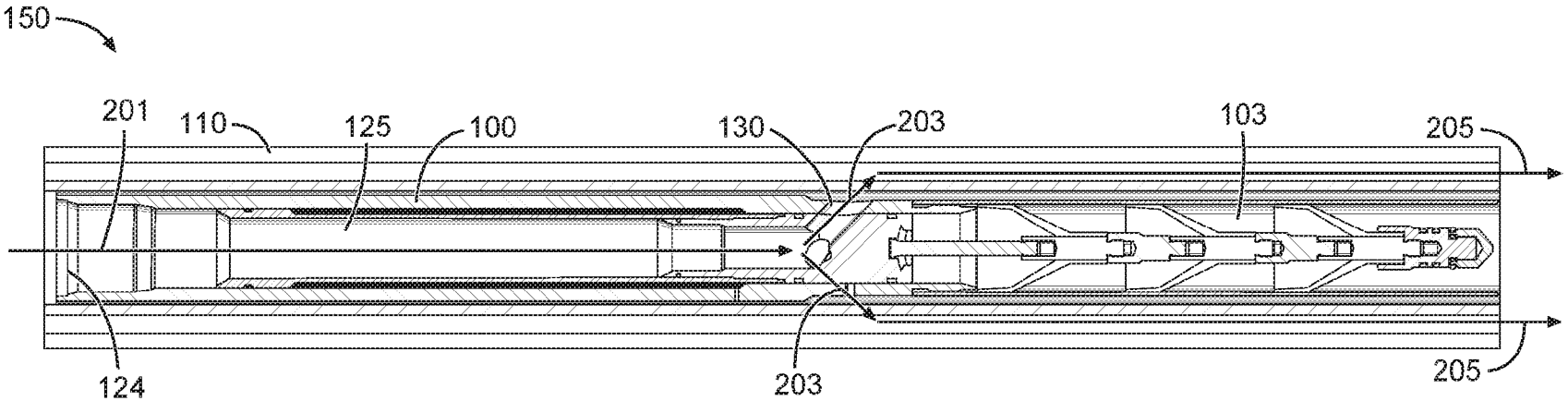
FIG. 2 is a cross-sectional diagram showing an example of an initial fluid flow in accordance with the subsurface wiping plug apparatus according to aspects of the present disclosure.

FIG. 2 is across-sectional diagram showing an example of an initial fluid flow in accordance with the subsurface wiping plug apparatus 150 according to aspects of the present disclosure. After the subsurface wiping plug apparatus 150 is lowered downhole on the running tool and reaches a desired depth in the wellbore, a fluid 201 (e.g., cement slurry) enters the opening 124 and traverses the internal bore 125 of the ported case 100. The fluid 203 then exits the case 100 at the ports 130 that circumferentially surround the apparatus 150.

The fluid 205 enters the annulus between the plug capsule 103 and the well casing 110. The fluid 205 then continues downhole after exiting the annulus between the case 100 and the well casing 110. The cement slurry is followed downhole by a smaller top plug 310 (see FIG. 3) that wipes the cement from the smaller tubulars (e.g., casing, drill pipe) above the subsurface wiping plug apparatus. The top plug enters the opening 124 and lands in the bore 125 of the apparatus 150. An end of the top plug lands on a landing seat and seals a baffle 330 that couples the internal bore 125 and the front ports 130.

Figure 3:
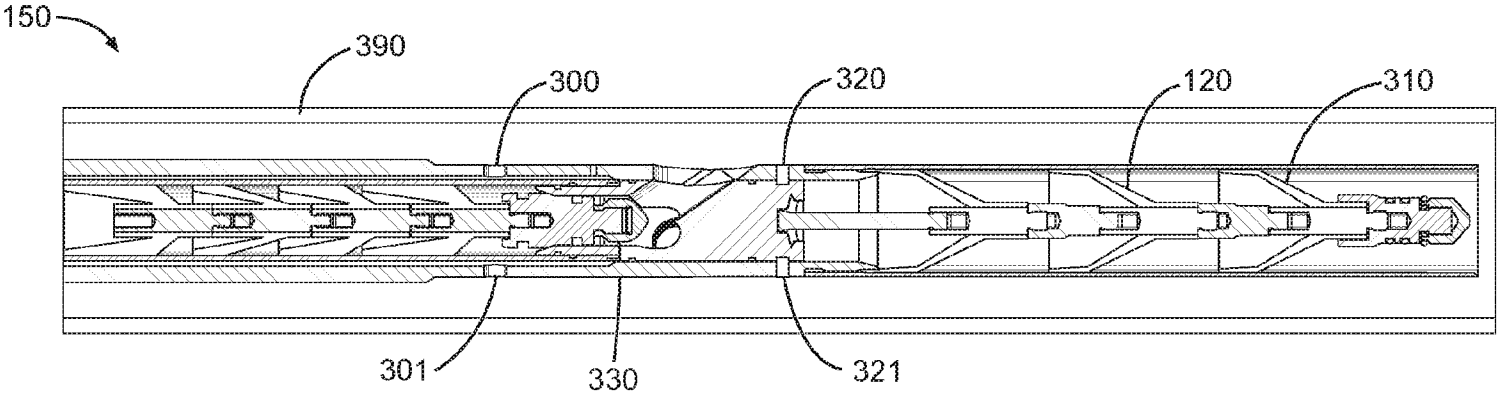
FIG. 3 is a cross-sectional diagram showing an example subsurface wiping plug apparatus in a well casing where the release device has landed in a bore according to aspects of the present disclosure.

FIG. 3 is a cross-sectional diagram showing an example subsurface wiping plug apparatus 150 in a well casing where the top wiping plug 310 has landed in a bore 125 according to aspects of the present disclosure. A release device 310 (e.g., top wiping plug) landing shuts off the flow of fluid through the casing. At this point, the casing is sealed by the apparatus 150 with cement in the casing below the apparatus 150. The release device may be a sphere or any other device that may be launched downhole to seal the apparatus and release the lower plug.

Fluid (e.g., water, displacement fluid) continues to build pressure behind the apparatus 150 in the casing. Once the pressure reaches a particular threshold, a plurality of shear pins 320, 321 in the apparatus 150 are sheared and the components of the apparatus 150 internal to the apparatus case 100 shift in the apparatus case 100 such that the lower plug 120 is now outside of the plug capsule 103. The pressure threshold to cause the shear pins 320, 321 to shear may be adjusted by using different shear strength pins or varying the number of shear pins. Present embodiments are not limited to any number of shear pins.

Figure 4:
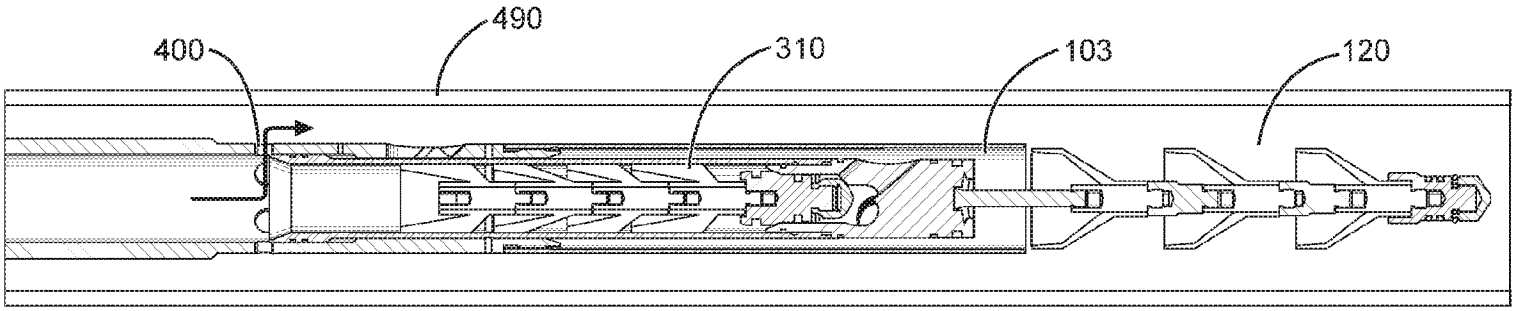
FIG. 4 is a cross-sectional diagram showing an example subsurface wiping plug apparatus in the casing with fluid flow re-established and the plug launched according to aspects of the present disclosure.

FIG. 4 is across-sectional diagram showing an example subsurface wiping plug apparatus in the casing with fluid flow re-established and the plug launched according to aspects of the present disclosure. The lower plug 120 has been launched (i.e., injected into the casing). Once the lower plug 120 is pushed out of the apparatus case 100 and fully into the casing, one or more rear ports 400 are exposed on the case 100. Since the top wiping plug 310 has closed off access of the bore 125 to the front ports 130, the fluid flow is reestablished through the rear ports 400 located circumferentially around the apparatus case 100 and behind the top wiping plug 310.

Once the fluid is allowed to flow out of the rear ports 400, the fluid may then flow around the annulus between the apparatus 150 and the well casing 490. The reestablished flow pushes the lower plug 120 downhole to wipe the casing of cement below the apparatus 150.

The above-described embodiment of the subsurface wiping plug apparatus describes the operation of the plug downhole. However, while the plug is housed within the apparatus, it is important that the plug not release prematurely. FIGS. 5-10 illustrate various embodiments for a plug retention assembly to hold the plug in the apparatus case until the appropriate time to be released.

Figure 5:
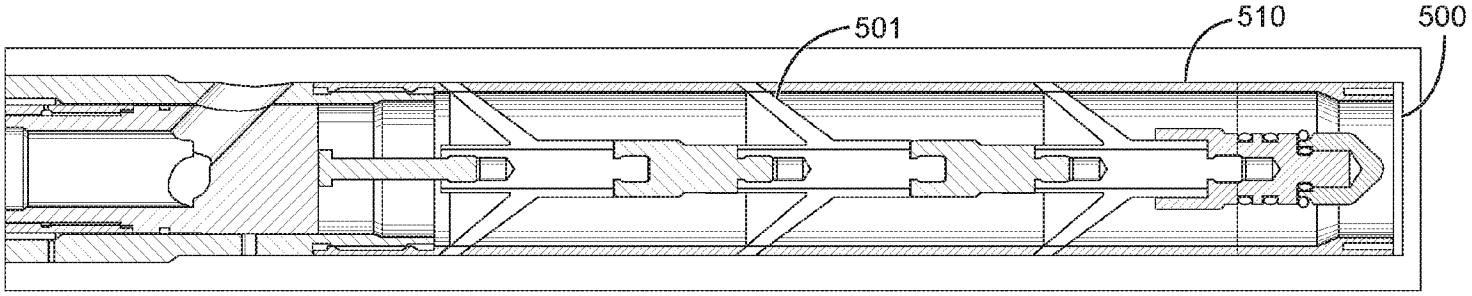
FIG. 5 is a cross-sectional diagram showing an example plug retention assembly according to aspects of the present disclosure.

FIG. 5 is a cross-sectional diagram showing an example plug retention assembly according to aspects of the present disclosure. This embodiment uses a cap 500 at the end of the apparatus case 510 to hold in the lower plug 501. The cap 500 holds in the lower plug 501 until the lower plug 501 is pushed through from behind.

The cap 500 may be a membrane that is broken (e.g., burst disk) when the lower plug 501 is pushed through it. In another embodiment, the cap 500 may be attached to the apparatus case 510 until pushed off by the lower plug 501.

Figure 6:
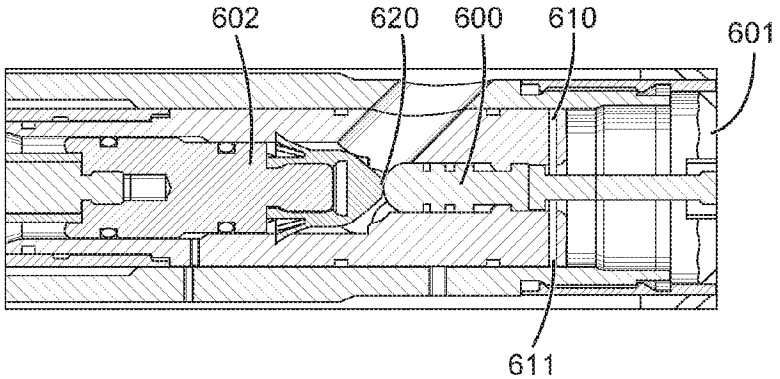
FIG. 6 is a cross-sectional diagram showing another example plug retention assembly in a locked state according to aspects of the present disclosure.

FIG. 6 is across-sectional diagram showing another example plug retention assembly in a locked state according to aspects of the present disclosure. This embodiment uses a plunger assembly 600 that is coupled to the end of the lower plug 601. When the top plug 602 enters the apparatus, as described previously, the end 620 of the top plug 602 impinges upon the plunger assembly 600, pushing the plunger assembly 600 through retention shear pins 610, 611. This enables the lower plug to be released downhole as described previously. The shear pins 610, 611 hold the plunger until a force threshold, greater than the designed structural strength of the shear pins 610, 611, is reached. The structural shear strength of the shear pins may be adjusted by using different materials and different material thicknesses.

Figure 7:
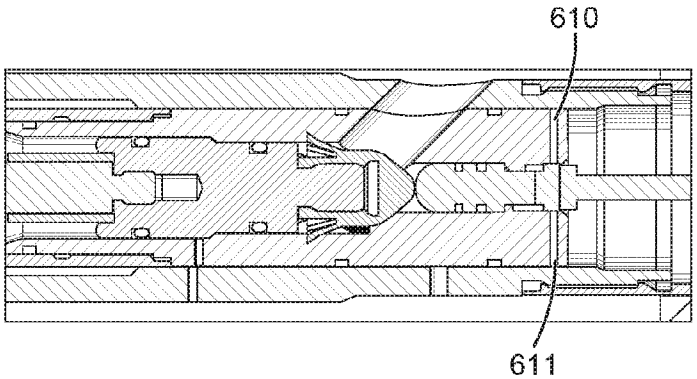
FIG. 7 is a cross-sectional diagram showing the example of the plug retention assembly in accordance with FIG. 6 in an unlocked state according to aspects of the present disclosure.

FIG. 7 is a cross-sectional diagram showing the example of the plug retention assembly in accordance with FIG. 6 in an unlocked state according to aspects of the present disclosure. This figure shows the plunger assembly 600 of FIG. 6 after it has been pushed through the shear pins 610, 611.

The above-described shear pins may be one or more actual pins that are sheared off by a particular force. In another embodiment, the term "shear pins" may cover other shear devices such as a circular shear device that breaks in a substantially similar manner to shear pins, thus allowing the assembly being retained by the shear device to be free to move.

Figure 8B:
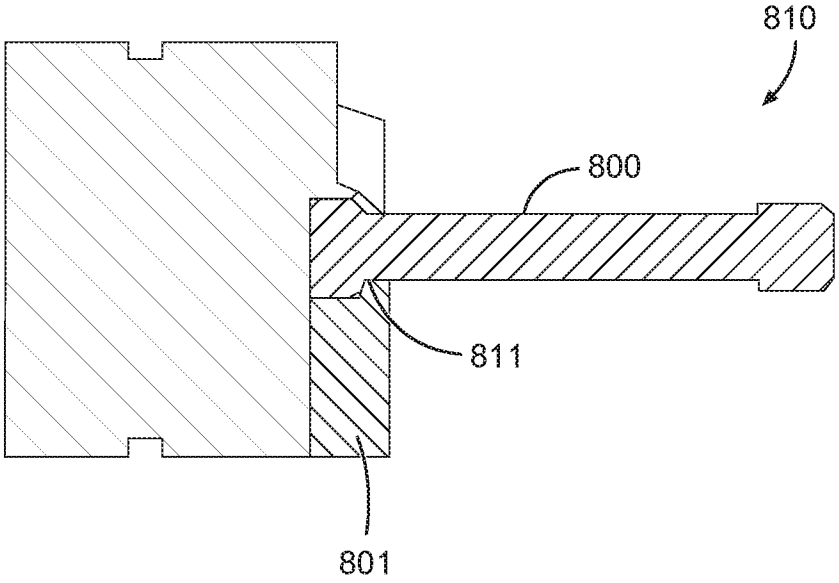
FIGS. 8A and 8B are diagrams showing another example plug retention assembly according to aspects of the present disclosure plug retention assembly.
Figure 8A:
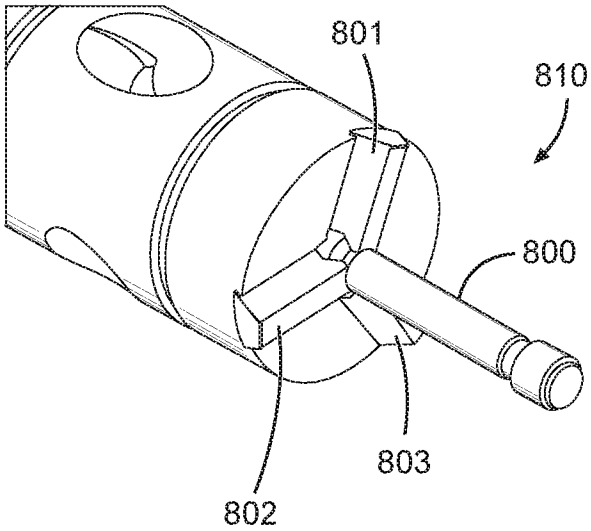

FIGS. 8A and 8B are diagrams showing another according to aspects of the present disclosure plug retention assembly. This embodiment uses a chucking assembly 810 to hold an extension 800 of the lower plug (not shown) in place.

The chucking assembly 810 includes a set of movable jaws 801-803 (e.g., chucks) that are oriented radially around the end of the wiping plug apparatus. FIG. 8B shows a cross-sectional view of one of the jaws 801 holding the extension 800 of the lower plug. An overlap 810 of the jaw 801 with the extension 800 retains the extension against the wiping plug apparatus end.

Figure 9:
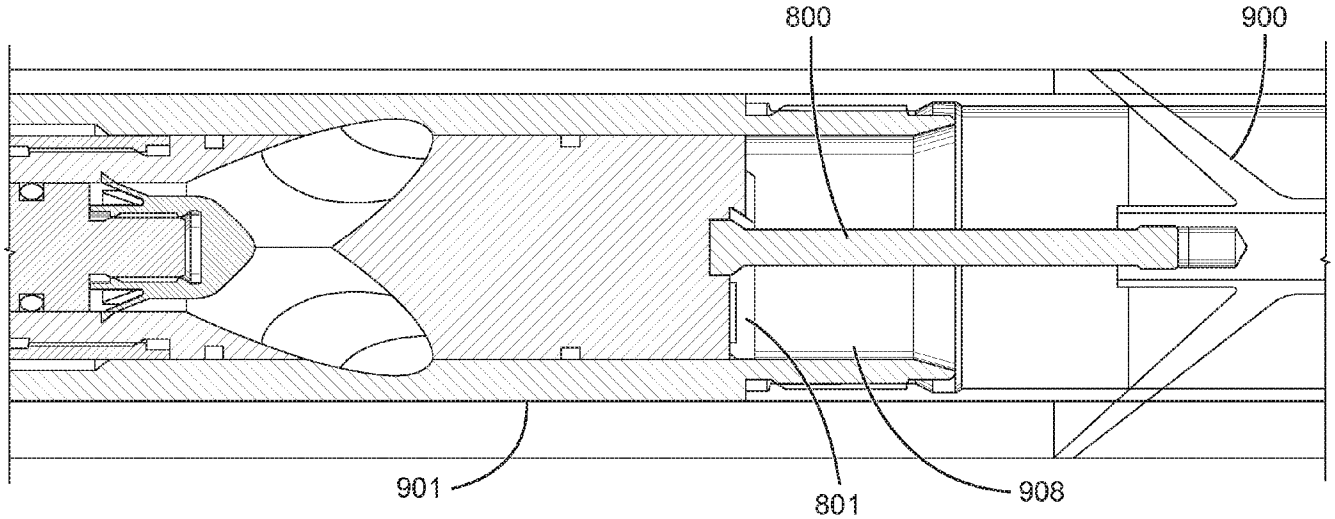
FIG. 9 is across-sectional diagram showing the plug retention assembly in accordance with FIG. 8 in an unactuated state according to aspects of the present disclosure.

FIG. 9 is a cross-sectional diagram showing the plug retention assembly in accordance with FIG. 8 in an unactuated state according to aspects of the present disclosure. The jaws 801-803 are held closed by the inside diameter 908 of the ported case 901 while in the unactuated state. Once the inside components of the wiping plug apparatus are pushed forward, as describe previously, the jaws 801-803 are allowed to expand and release the extension 800 with the attached lower plug 900.

Figure 10:
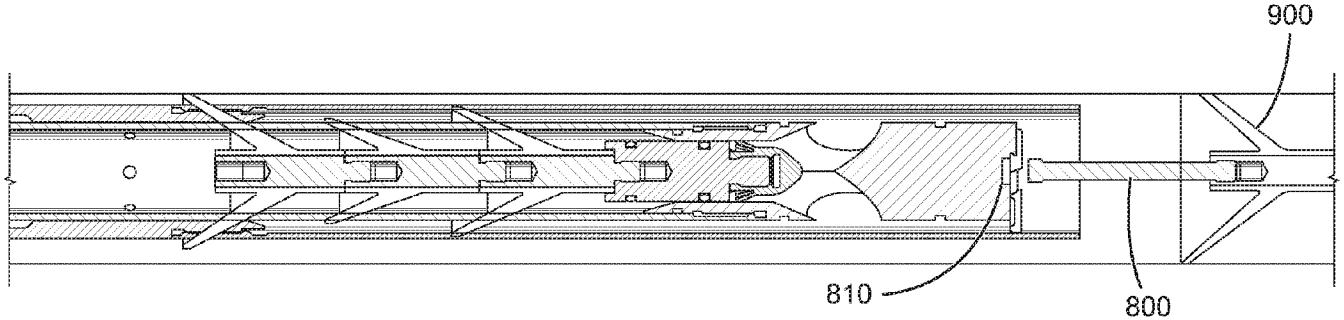
FIG. 10 is across-sectional diagram showing the plug retention assembly in accordance with FIG. 8 in an actuated state according to aspects of the present disclosure.

FIG. 10 is a cross-sectional diagram showing the plug retention assembly in accordance with FIG. 8 in an actuated state according to aspects of the present disclosure. This Figure shows the lower plug 900 being released when the extension 800 is released from the chucking assembly 810.

The jaws 801-803 of the chucking assembly 810 may be spring-loaded (e.g., radially) to enable them to expand outward and remain in the expanded, actuated state. In another embodiment, the jaws 801-803 are allowed to move outward on their own in response to axial pressure from the extension.

Figure 11:
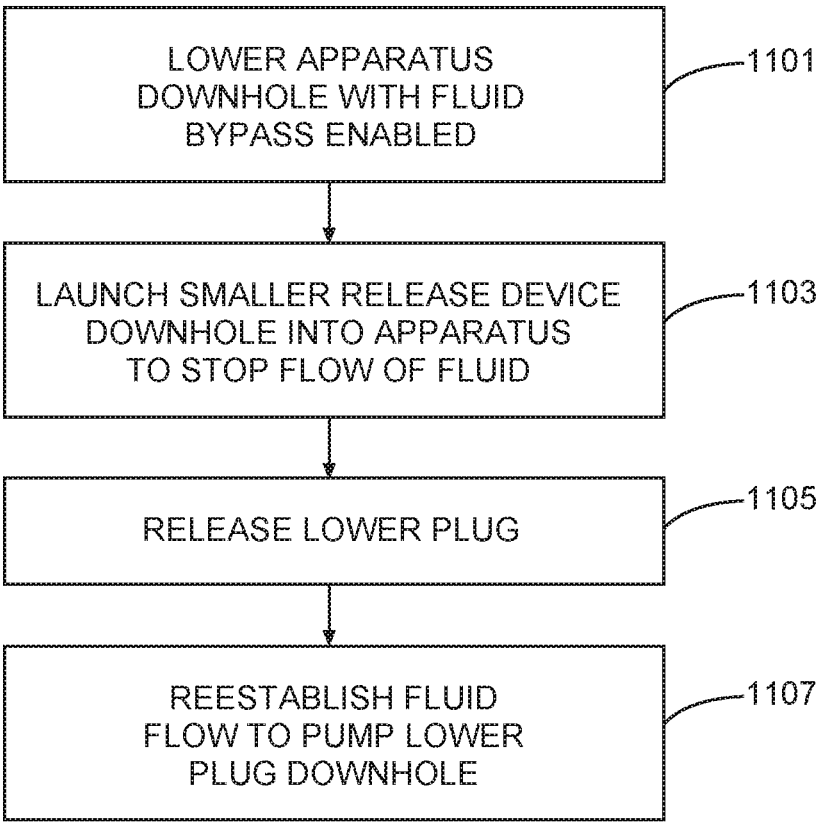
FIG. 11 is a flowchart of an example method for operation of the subsurface wiping plug assembly in a downhole environment according to aspects of the present disclosure.
Figure 12:
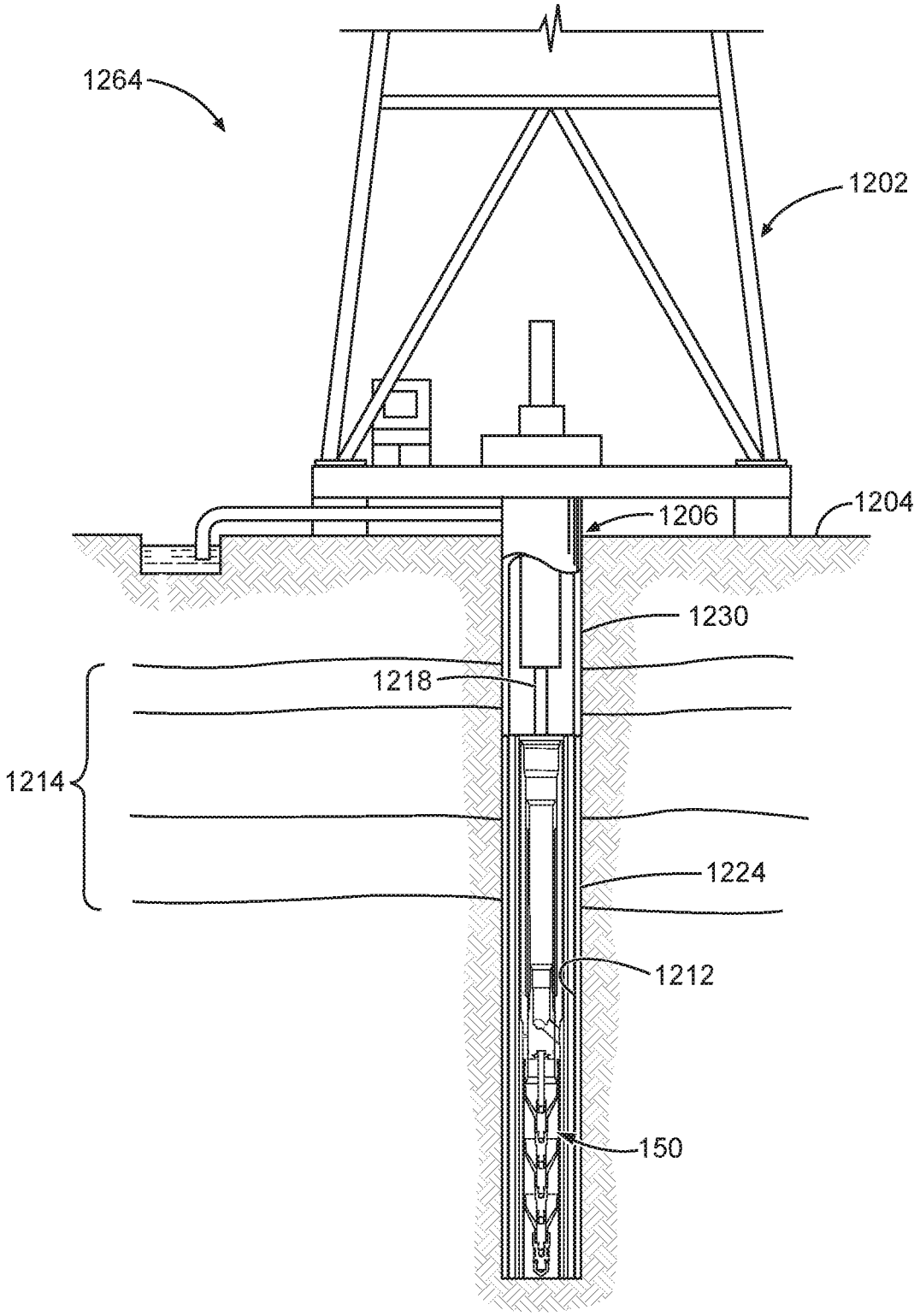
FIG. 12 is a diagram showing an example system according to aspects of the present disclosure.

FIG. 11 is a flowchart of an embodiment of a method for operation of the subsurface wiping plug apparatus in a downhole environment according to aspects of the present disclosure. The method may be performed by the apparatus described previously after a drilling operation. One example of the apparatus in a wellbore after drilling is illustrated in FIG. 12 and described subsequently.

In block 1101, the subsurface wiping plug apparatus is attached to the running tool and drill pipe and lowered downhole. A fluid (e.g., cement slurry is pumped downhole after the apparatus has reached the desired depth. The apparatus includes the bypass mechanism (e.g., ported case) disclosed previously to enable the fluid to flow through the annulus around the apparatus instead of through the lower plug.

In block 1103, a smaller release device (e.g., top plug) is launched downhole. The release device wipes cement from the smaller casing or drill pipe above the apparatus. The top plug then lands in the bore of the apparatus and stops the flow of the fluid out of the forward ports of the ported case of the apparatus.

In block 1105, the lower plug that resides in the apparatus is released. The release may be accomplished using one or more of the embodiments illustrated in FIGS. 5-10.

In block 1107, the build-up of pressure behind the apparatus causes the internal components of the apparatus to move forward within the ported case. This movement exposes rear ports in the ported case to reestablish the fluid flow. This fluid flow causes the pressure to push the plug downhole.

FIG. 12 is a diagram showing an example system according to aspects of the present disclosure. The drilling rig system 1264 includes a drilling rig 1202 located at the surface 1204 of a well 1206. The borehole 1212 is assumed to have already been drilled through a formation 1214 by a drill string 1218 with a drillbit (not shown). The drillbit has been removed at this point and the drill string 1218 is used to lower the running tool with the apparatus 150 attached. Conductor casing 1230 has been installed.

The borehole 1212 may be lined with a casing 1224. The casing may be held in place and stabilized by cement injected downhole. The subsurface wiping plug apparatus 150 discussed previously may be used during a production casing assembly operation. On method of operation of the subsurface wiping plug during the drilling operation is illustrated in FIG. 11.

Figure 13:
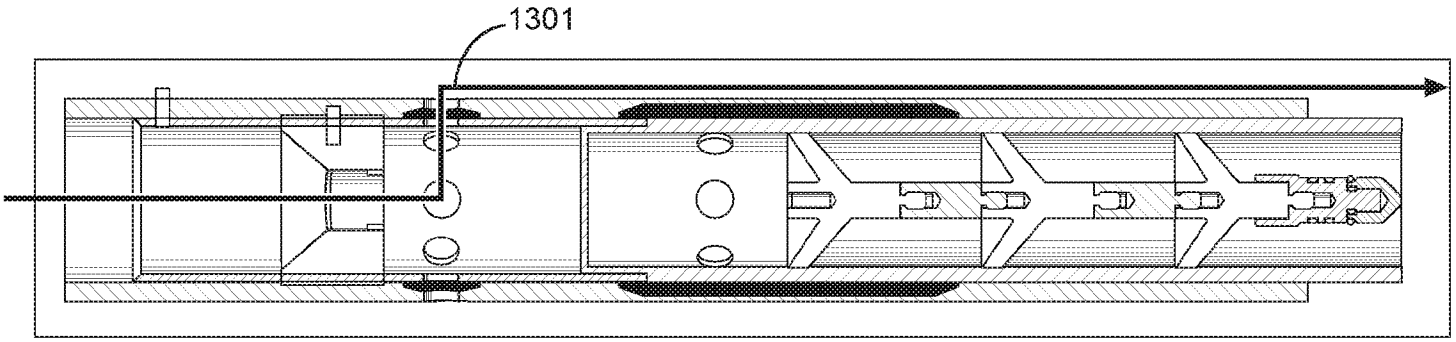
FIG. 13 is a cross-sectional diagram showing another example subsurface wiping plug apparatus in a run-in-hole configuration according to aspects of the present disclosure.

FIG. 13 is across-sectional diagram showing another example subsurface wiping plug apparatus in a run-in-hole configuration according to aspects of the present disclosure. This is the configuration that the apparatus is in as it is lowered it into the well.

A fluid (e.g., cement) is then pumped down the well. The fluid enters a rear opening in the apparatus and exits through a set of rear ports 1301 in the apparatus case. The arrow of FIG. 13 illustrates the fluid flow through the apparatus and down the annulus between the apparatus and the well casing.

A release device (e.g., top plug) (not shown) lands on a baffle (e.g., restriction) inside the central bore of the apparatus. The top plug shuts off the flow of the fluid through the apparatus and enables a fluid pressure to build behind the apparatus.

Figure 14:
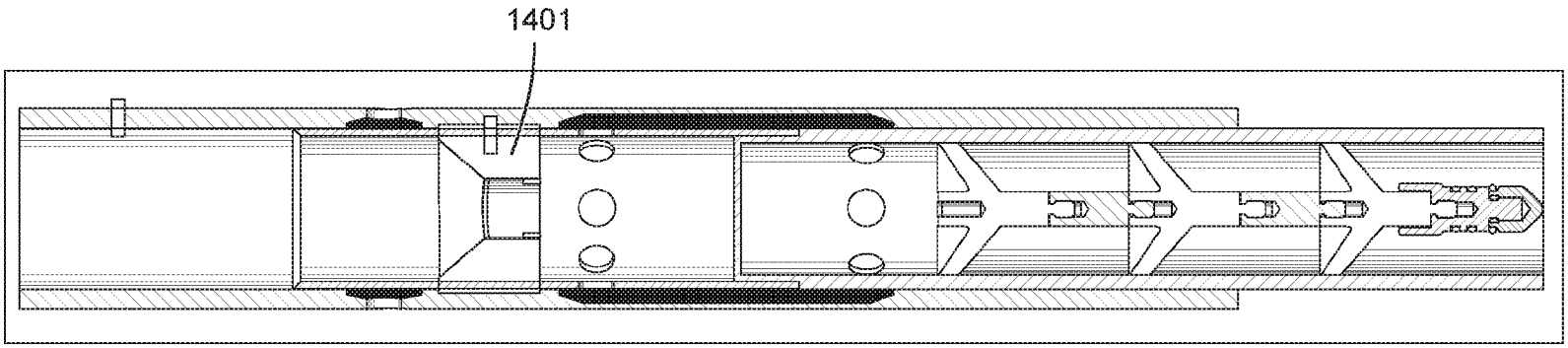
FIG. 14 is a cross-sectional diagram showing an example subsurface wiping plug apparatus, in accordance with the embodiment of FIG. 13, after shifting of internal components according to aspects of the present disclosure.

The internal components of the apparatus are shifted to the right as a result of the pressure. FIG. 14 is across-sectional diagram showing an example subsurface wiping plug apparatus, in accordance with the embodiment of FIG. 13, after shifting of internal components according to aspects of the present disclosure.

Figure 15:
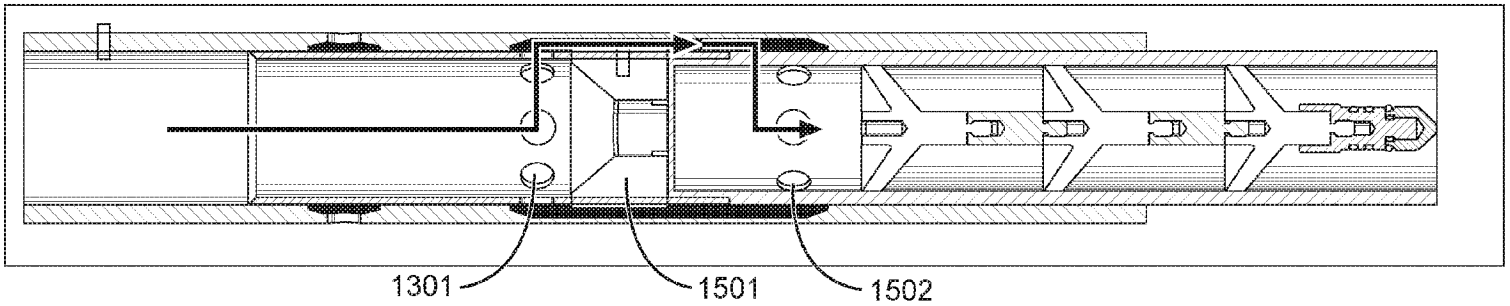
FIG. 15 is a cross-sectional diagram showing an example subsurface wiping plug apparatus, in accordance with the embodiment of FIG. 13, after shifting of a baffle according to aspects of the present disclosure.
Figure 16:
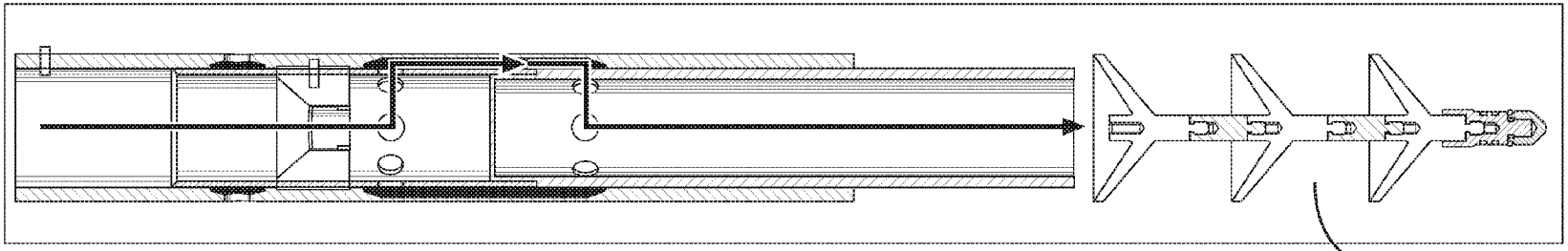
FIG. 16 is a cross-sectional diagram showing an example subsurface wiping plug apparatus, in accordance with the embodiment of FIG. 13, after launch of the wiping plug according to aspects of the present disclosure.

FIG. 15 is a cross-sectional diagram showing an example subsurface wiping plug apparatus, in accordance with the embodiment of FIG. 13, after shifting of a baffle according to aspects of the present disclosure. Pressure once again builds behind the baffle 1501 on which the top plug has landed. The baffle shifts to the right passing a set of front ports 1502 in the apparatus case. Once the baffle 1501 is shifted, the displacement fluid has a path that it can travel through an annular internal upset. The fluid flow is shown by the arrow in FIG. 15 as exiting the apparatus as the set of rear ports 1301 and reentering the apparatus at the set of front ports 1502. The set of front ports are coupled to a release mechanism, examples of which have been discussed previously, such that the pressure of the displacement fluid flow can release the lower plug 1601 and push the lower dart 1601 downhole as illustrated in FIG. 16. Accordingly, FIG. 16 is a cross-sectional diagram showing an example subsurface wiping plug apparatus, in accordance with the embodiment of FIG. 13, after launch of the wiping plug according to aspects of the present disclosure.

In the embodiment of FIGS. 13-16, the displacement fluid is diverted from the central flow path within the apparatus, through the annular internal upset. In the previous embodiment of FIGS. 1-4, the displacement fluid flows through the outside of the tool, along the annulus between the tool and casing.

Further examples include, but are not limited to:

Example 1 is a subsurface wiping plug apparatus comprising an internal bore extending through only a portion of the apparatus, wherein the portion is less than a length of the apparatus; a ported case wherein each port of the case is configured to couple the internal bore to an external side of the case; and a plug capsule coupled to the ported case, the plug capsule containing an internal wiping plug.

In Example 2, the subject matter of Example 1 can further include wherein the wiping plug comprises a solid core.

In Example 3, the subject matter of any of Examples 1-2 can optionally include, wherein the ported case comprises a plurality of front ports arranged circumferentially around a front portion of the case and configured to be coupled between the external side of the case and the internal bore when slidable internal components of the case are in a first configuration; and a plurality of rear ports arranged circumferentially around a rear portion of the case and configured to be coupled between the external side of the case and the internal bore when the slidable internal components of the case are in a second configuration, wherein the second configuration comprises the internal wiping plug extending out of the plug capsule.

In Example 4, the subject matter of Example 3 can optionally include wherein the slidable internal components of the case include the internal bore and the internal wiping plug.

In Example 5, the subject matter of any of Examples 3-4 can optionally further comprise a baffle that couples the internal bore to the plurality of front ports.

In Example 6, the subject matter of any of Examples 1-5 can optionally include wherein the internal wiping plug is slidable within the plug capsule such that the wiping plug can extend out of an end of the plug capsule.

In Example 7, the subject matter of Example 6 can optionally include wherein the internal wiping plug is releasably coupled to the apparatus such that, once outside the plug capsule, the wiping plug is releasable from the apparatus.

In Example 8, the subject matter of any of Examples 1-7 can optionally further comprise a plunger coupled to the internal wiping plug and releasably coupled to the apparatus; and shear pin configured to retain the plunger in the apparatus until a force on the plunger exceeds a structural shear strength of the shear pin.

In Example 9, the subject matter of Example 8 can optionally include wherein the shear pin is one of a plurality of shear pins.

In Example 10, the subject matter of Example 8 can optionally include wherein the shear pin comprises a circular shear device.

In Example 11, the subject matter of any of Examples 1-10 can optionally comprise a membrane covering an end of the plug capsule and configured to retain the wiping plug within the capsule.

In Example 12, the subject matter of any of Examples 1-11 can optionally comprise an extension coupled to the internal wiping plug; and a chucking assembly coupled to the apparatus that releasably holds the extension.

In Example 13, the subject matter of Example 12 can optionally include wherein the chucking assembly comprises a plurality of movable jaws radially configured to releasably hold an end of the extension.

In Example 14, the subject matter of Example 13 can optionally include wherein the plurality of movable jaws are spring-loaded within the apparatus.

In Example 15, the subject matter of any of Examples 1-14 can optionally comprise a plurality of rear ports in the ported case, the plurality of rear ports coupled to an internal bore when slidable internal components of the ported case are in a first configuration and second configuration; and a plurality of front ports in the ported case, the plurality of front ports coupled to the internal wiping plug in the second configuration and not in the first configuration.

Example 16 is a method for operation of a subsurface wiping plug apparatus, the method comprising launching the subsurface wiping plug apparatus into a borehole casing, the subsurface wiping plug apparatus comprising a fluid bypass portion including an internal bore through which fluid enters the apparatus and at least one port, located on a case of the apparatus, through which fluid exits, wherein the fluid bypass portion extends for less than a length of the apparatus; initiating a fluid flow down the borehole casing, through the fluid bypass portion, and around an annulus region between the case and the borehole casing; stopping the fluid flow through the fluid bypass portion; releasing a lower plug of the apparatus; and reestablishing the fluid flow through the apparatus to pump the lower plug downhole.

In Example 17, the subject matter of Example 16 can optionally include wherein stopping the fluid flow through the fluid bypass portion comprises launching a release device downhole in the borehole casing such that the release device is configured to enter the internal bore and stop fluid exiting the at least one port.

In Example 18, the subject matter of Example 17 can optionally include wherein reestablishing the fluid flow through the apparatus comprises sliding internal components of the apparatus within the case to expose rear ports located circumferentially on the case.

In Example 19, the subject matter of any of Examples 16-18 can optionally include wherein releasing the lower plug of the apparatus comprises releasing jaws of a chucking assembly that hold an extension of the lower plug, the jaws of the chucking assembly being released when slidable internal components of the apparatus slide out a front of the apparatus.

In Example 20, the subject matter of Example 17 can optionally include wherein releasing the lower plug of the apparatus comprises the top wiping plug hitting a plunger coupled to the lower plug such that shear pins, holding the plunger to the apparatus, are sheared.

In Example 21, the subject matter of Example 17 can optionally include wherein the at least one port is a plurality of circumferentially located rear ports and reestablishing the fluid flow comprises shifting internal components of the apparatus such that a plurality of circumferentially located front ports are coupled to a release mechanism of the lower plug.

Example 22 is a system comprising a drill siring configured to lower a running tool in a geological formation; and a subsurface wiping plug apparatus, coupled to the running tool, configured to be lowered into a borehole casing, the subsurface wiping plug apparatus comprising an internal bore extending through less than a length of the apparatus; a ported case wherein each port of the case is configured to couple the internal bore to an external side of the case; and a plug capsule coupled to the ported case, the plug capsule containing a lower wiping plug.

In Example 23, the subject matter of Example 22 can further include a baffle that couples the internal bore to a plurality of circumferentially located ports on the ported case to divert fluid flow from the internal bore.

In Example 24, the subject matter of Example 23 can further include wherein the baffle is configured to be sealed by a release device located in the internal bore.

In Example 25, the subject matter of any of Examples 22-24 can optionally include wherein internal components within the ported case are configured to be slidable within the ported case such that the lower wiping plug is extendable beyond an end of the plug capsule.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A subsurface wiping plug apparatus comprising:

a slidable sleeve comprising an internal bore extending through only a portion of the slidable sleeve, wherein the portion is less than a length of the slidable sleeve;

a ported case with the slidable sleeve positioned within the case, wherein each port of the case is configured to couple the internal bore to an external side of the case; and a plug capsule coupled to the ported case, the plug capsule containing an internal wiping plug.

2. The apparatus of claim 1, wherein the wiping plug comprises a solid core.

3. The apparatus of claim 1, wherein the ported case comprises:

a plurality of front ports arranged circumferentially around a front portion of the case and configured to be coupled between the external side of the case and the internal bore when slidable internal components of the case are in a first configuration; and a plurality of rear ports arranged circumferentially around a rear portion of the case and configured to be coupled between the external side of the case and the internal bore when the slid internal components of the case are in a second configuration, wherein the second configuration comprises the internal wiping plug extending out of the plug capsule.

4. The apparatus of claim 3, wherein the slidable internal components of the case include the slidable sleeve and the internal wiping plug.

5. The apparatus of claim 3, further comprising a baffle that couples the internal bore to the plurality of front ports.

6. The apparatus of claim 1, wherein the internal wiping plug is slidable within the plug capsule such that the wiping plug can extend out of an end of the plug capsule.

7. The apparatus of claim 6, wherein the internal wiping plug is releasably coupled to the apparatus such that, once outside the plug capsule, the wiping plug is releasable from the apparatus.

8. The apparatus of claim 1, further comprising:

a plunger coupled to the internal wiping plug and releasably coupled to the apparatus; and a shear pin configured to retain the plunger in the apparatus until a force on the plunger exceeds a structural shear strength of the shear pin.

9. The apparatus of claim 8, wherein the shear pin is one of a plurality of shear pins.

10. The apparatus of claim 8, wherein the shear pin comprises a circular shear device.

11. The apparatus of claim 1, further comprising a membrane covering an end of the plug capsule and configured to retain the wiping plug within the capsule.

12. The apparatus of claim 1, further comprising:

an extension coupled to the internal wiping plug; and a chucking assembly coupled to the apparatus that releasably holds the extension.

13. The apparatus of claim 12, wherein the chucking assembly comprises a plurality of movable jaws radially configured to releasably hold an end of the extension.

14. The apparatus of claim 13, wherein the plurality of movable jaws are spring-loaded within the apparatus.

15. The apparatus of claim 1, further comprising:

a plurality of rear ports in the ported case, the plurality of rear ports coupled to an internal bore when slidable internal components of the ported case are in a first configuration and second configuration; and a plurality of front ports in the ported case, the plurality of front ports coupled to the internal wiping plug in the second configuration and not in the first configuration.

16. A method for operation of a subsurface wiping plug apparatus, the method comprising:

launching the subsurface wiping plug apparatus into a borehole casing, the subsurface wiping plug apparatus comprising a slidable sleeve with a fluid bypass portion including an internal bore through which fluid enters the apparatus and at least one port, located on a case of the apparatus with the slidable sleeve positioned within the case, through which fluid exits, wherein the fluid bypass portion extends for less than a length of the slidable sleeve;

initiating a fluid flow down the borehole casing, through the fluid bypass portion, and around an annulus region between the case and the borehole casing;

stopping the fluid flow through the fluid bypass portion;

releasing a lower plug of the apparatus; and reestablishing the fluid flow through the apparatus to pump the lower plug downhole.

17. The method of claim 16, wherein stopping the fluid flow through the fluid bypass portion comprises launching a release device downhole in the borehole casing such that the release device is configured to enter the internal bore and stop fluid exiting the at least one port.

18. The method of claim 17, wherein reestablishing the fluid flow through the apparatus comprises sliding internal components of the apparatus within the case to expose rear ports located circumferentially on the case.

19. The method of claim 16, wherein releasing the lower plug of the apparatus comprises releasing jaws of a chucking assembly that hold an extension of the lower plug, the jaws of the chucking assembly being released when slidable internal components of the apparatus slide out a front of the apparatus.

20. The method of claim 17, wherein releasing the lower plug of the apparatus comprises a top wiping plug hitting a plunger coupled to the lower plug such that shear pins, holding the plunger to the apparatus, are sheared.

21. The method of claim 17, wherein the at least one port is a plurality of circumferentially located rear ports and reestablishing the fluid flow comprises shifting internal components of the apparatus such that a plurality of circumferentially located front ports are coupled to a release mechanism of the lower plug.

22. A system comprising:

a drill string configured to lower a running tool in a geological formation; and a subsurface wiping plug apparatus, coupled to the running tool, configured to be lowered into a borehole casing, the subsurface wiping plug apparatus comprising:

an internal bore extending through less than a length of the apparatus;

a ported case wherein each port of the case is configured to couple the internal bore to an external side of the case;

a plug capsule coupled to the ported case, the plug capsule containing a lower wiping plug; and a baffle that couples the internal bore to a plurality of circumferentially located ports on the ported case to divert fluid flow from the internal bore.

23. The system of claim 22, wherein the baffle is configured to be sealed by a release device located in the internal bore.

24. The system of claim 22, wherein a slidable sleeve is configured to be slidable within the ported case such that the lower wiping plug is extendable beyond an end of the plug capsule.

* * * * *